US007734319B2

(12) United States Patent
Akasegawa

(10) Patent No.: US 7,734,319 B2
(45) Date of Patent: Jun. 8, 2010

(54) DUAL-MODE SUPERCONDUCTIVE FILTER HAVING AN OPENING PATTERN IN A GROUND PLANE

(75) Inventor: Akihiko Akasegawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 70 days.

(21) Appl. No.: 11/972,134

(22) Filed: Jan. 10, 2008

(65) Prior Publication Data

US 2008/0167190 A1 Jul. 10, 2008

(30) Foreign Application Priority Data

Jan. 10, 2007 (JP) ..... 2007-002619

(51) Int. Cl.
*H01P 1/203* (2006.01)
*H01B 12/02* (2006.01)

(52) U.S. Cl. ..... 505/210; 333/99 S; 333/204

(58) Field of Classification Search ..... 333/99 S, 333/204, 219; 505/210
See application file for complete search history.

(56) References Cited

U.S. PATENT DOCUMENTS

| | | | | |
|---|---|---|---|---|
| 6,577,211 | B1 * | 6/2003 | Tsujiguchi | 333/204 |
| 6,624,729 | B2 * | 9/2003 | Wright et al. | 333/238 |
| 6,889,068 | B2 * | 5/2005 | Kai et al. | 505/210 |
| 2005/0256010 | A1 * | 11/2005 | Nakanishi et al. | 505/210 |
| 2007/0194864 | A1 * | 8/2007 | Yoon et al. | 333/204 |

OTHER PUBLICATIONS

Sang Yeol Lee et al. "Role of Perturbations for Dual Mode Superconducting Microstrip Resonators Fabricated by Laser Ablation," IEEE Transactions on Applied Superconductivity, vol. 5; No. 2; Jun. 1995; pp. 2567-2570.

* cited by examiner

*Primary Examiner*—Benny Lee
(74) *Attorney, Agent, or Firm*—Westerman, Hattori, Daniels & Adrian, LLP

(57) ABSTRACT

A superconductive device that includes a ground film made of the superconductive material, wherein part of the ground film has an opening pattern.

14 Claims, 7 Drawing Sheets

DUAL-MODE SUPERCONDUCTIVE FILTER HAVING AN OPENING PATTERN IN A GROUND PLANE

CROSS-REFERENCE TO RELATED APPLICATIONS

This application is based upon and claims the benefit of priority from the prior Japanese Patent Application No. 2007-2619, filed on Jan. 10, 2007, the entire contents of which are incorporated herein by reference.

TECHNICAL FIELD

The present invention relates to a dual-mode superconductive device applied to a transmitter front end, such as a transmit filter, in the fields of mobile communication and broadcasting.

BACKGROUND

In connection with the recent widespread use of mobile phones or advances thereof, high-speed, large-capacity signal transmission has become an essential technology. Superconductors have significantly smaller surface resistance even in a high frequency region than typical electric conductors. Use of a superconductor can thus achieve a low-loss, high-Q resonator, and a resonator using a superconductor (superconductive device) is a promising device as a filter for a mobile communication base station.

When such a superconductive device is applied to a bandpass filter on the receive side, it is expected that the bandpass filter has low signal transmission loss and a sharp frequency cutoff characteristic. On the other hand, when such a superconductive device is applied to a bandpass filter on the transmit side, it is expected that the bandpass filter can remove signal distortion generated in a power amplifier disposed in the front end stage. However, in such a case, there is a problem of requiring a large amount of power for transmitting high frequency signals. That is, when a superconductive device is applied to a bandpass filter on the transmit side, achieving size reduction and a satisfactory power characteristic at the same time is an immediate challenge.

When a superconductive device is applied to a bandpass filter on the transmit side, there is a problem with transmission loss due to high RF power input. This problem of the transmit loss is, in other words, a problem of current density concentration. To eliminate this problem of current density concentration, it has been proposed that a linear pattern, such as a hairpin pattern and a microstrip pattern, be replaced with a disc (circular) shape superconductive resonator pattern. In a disc shape superconductive resonator pattern, the current density concentration at a linear edge can be reduced, as compared to a linear superconductive resonator pattern.

As shown in FIGS. 1A and 1B, there has also been proposed a dual-mode filter having a notch (cutout) in part of a disc superconductive resonator pattern, which induces resonant modes in two direction perpendicular to each other. (For example, refer to Sang Yeol Lee, Kwang Yong Kang, and Dal Ahn, IEEE Transactions on Applied Superconductivity, Vol. 5, No. 2, page 2567, June 1995.)

As shown in FIGS. 1A and 1B, in the conventional dual-mode resonator filter, a disc resonator pattern 102 formed of a superconductive film is provided on a dielectric substrate 101. FIG. 1B is a schematic cross-sectional view of the resonator shown in FIG. 1A taken along the line that connects input/output signal lines 103 to a notch 105. The notch 105 is formed in part of the disc resonator pattern 102 to induce dual modes, as best seen in FIG. 1A. In the conventional dual-mode resonator filter, the notch 105 is provided at a position apart from the extensions of the input/output signal lines (feeders) 103. The back side of the dielectric substrate 101 is entirely covered with a ground film 104, as shown in FIG. 1B.

FIG. 1C is a graph showing the frequency response characteristic of the superconductive resonator filter shown in FIGS. 1B and 1C. In the graph shown in FIG. 1C, the horizontal axis represents the frequency (GHz), and the vertical axis represents the magnitude (dB) indicative of the signal transmission characteristic.

As a result of the simulation, the reflective characteristic (S11) and the transmissive characteristic (S21) shown in FIG. 1C are obtained. Specifically, the sample has two resonant frequencies. 4.862 GHz (f1) and 5.051 GHz (f2), in the 5-GHz band.

In such a dual-mode resonator filter, degeneracy of the electric and magnetic modes perpendicular to each other is broken to separate resonant frequencies, so that two resonant frequencies f1 (on the low frequency side) and f2 (on the high frequency side) are generated, as shown in FIG. 1C. However, provision of the notch 105 causes the problem of current density concentration at the corners of the notch 105.

FIGS. 2A and 2B show the results of simulation of current density distribution in the conventional notch-type dual resonator. As shown in FIG. 2A, the current on the low frequency f1 side (especially compared to the High frequency f2 side concentrates at the corners of the notch 105 in the resonator plane, and hence exceeds the maximum current density in a typical disc resonator without the notch 105. In this example, a maximum current density of 702 A/m is induced on the f1 side, as shown in the left hand drawing in FIG. 2A.

On the other hand, as shown in FIG. 2B, since the back side (ground plane) of the dielectric substrate 101 is entirely covered with a superconductive film, there is substantially no local concentration of current density. It is however noted that the current density slightly rises around the center of the substrate along the current directions in the two resonant modes. The current directions in the two resonant modes refer to a first direction toward the notch 105 and a second direction perpendicular to the first direction. The resonant frequencies f1 and f2 are out of phase by 45 degrees with respect to each other at the maximum current density.

As described above, in the conventional dual-mode resonator filter, the current density concentrates at the corners or the edge of the notch 105 in the resonator pattern 102. As a result, in a bandpass filter and an antenna using a superconductive resonator, the withstanding power, which is the allowable power value (allowable power), is reduced, or the signal distortion increases in a disadvantageous manner.

Accordingly, the conventional technology cannot provide a superconductive device with high power handling capability and reduced concentration of the current density (signal distortion).

SUMMARY OF THE INVENTION

The present invention is directed to various embodiments of a superconductive device that includes a ground film made of the superconductive material, wherein part of the ground film has an opening pattern.

DETAILED DESCRIPTION OF THE EMBODIMENTS

A preferred embodiment of the invention will be described with reference to FIGS. 3A, 3B, 4A-4C, 5A-5C, 6, and 7A, 7B.

Figure 1A:
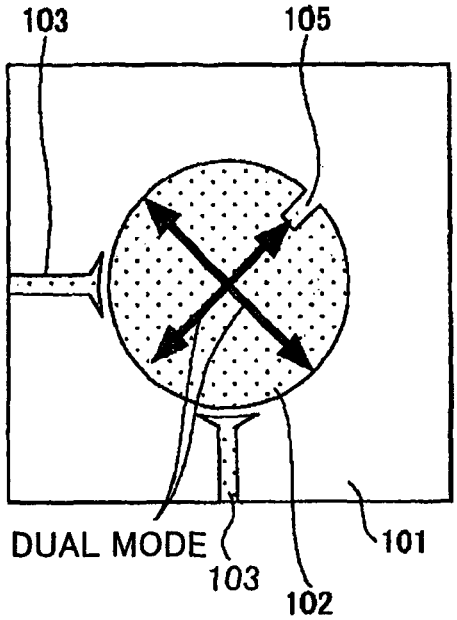
FIG. 1A PRIOR ART
FIGS. 1A to 1C explain a conventional notch-type dual-mode resonator filter.
Figure 1B:
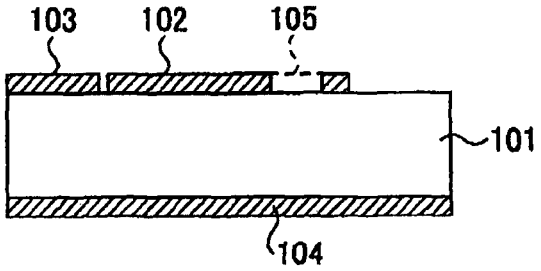
FIG. 1B PRIOR ART
Figure 1C:
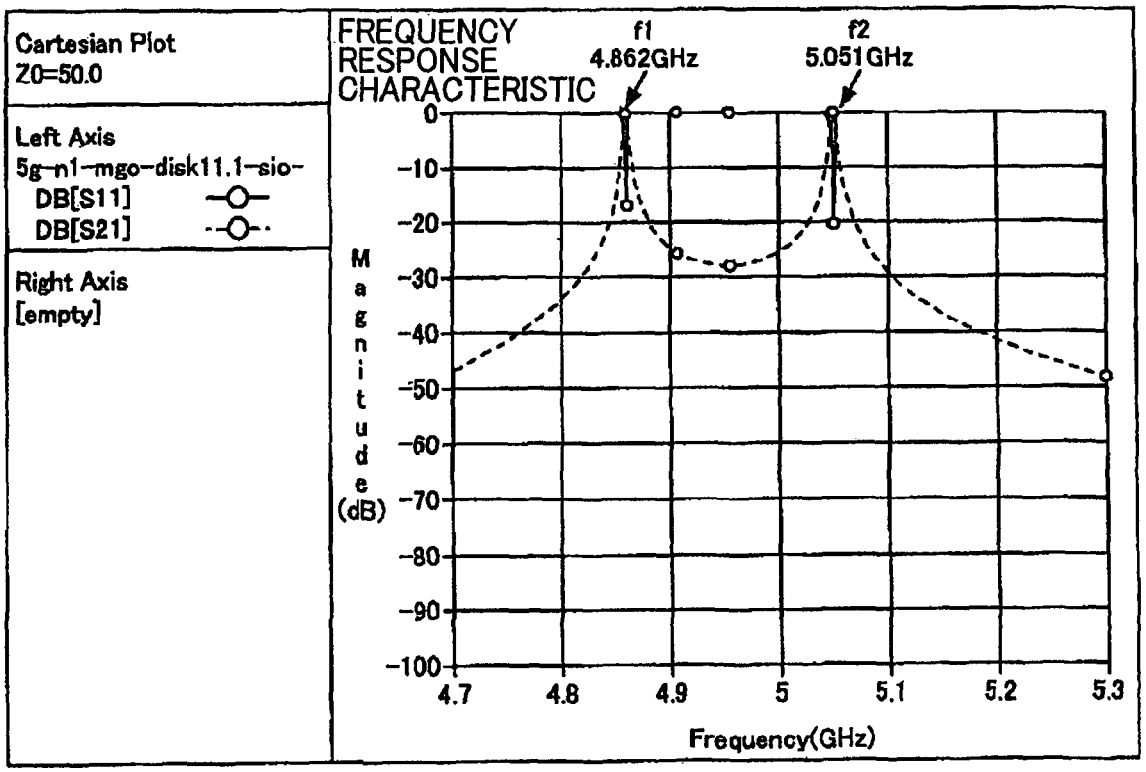
FIG. 1C PRIOR ART
Figure 2A:
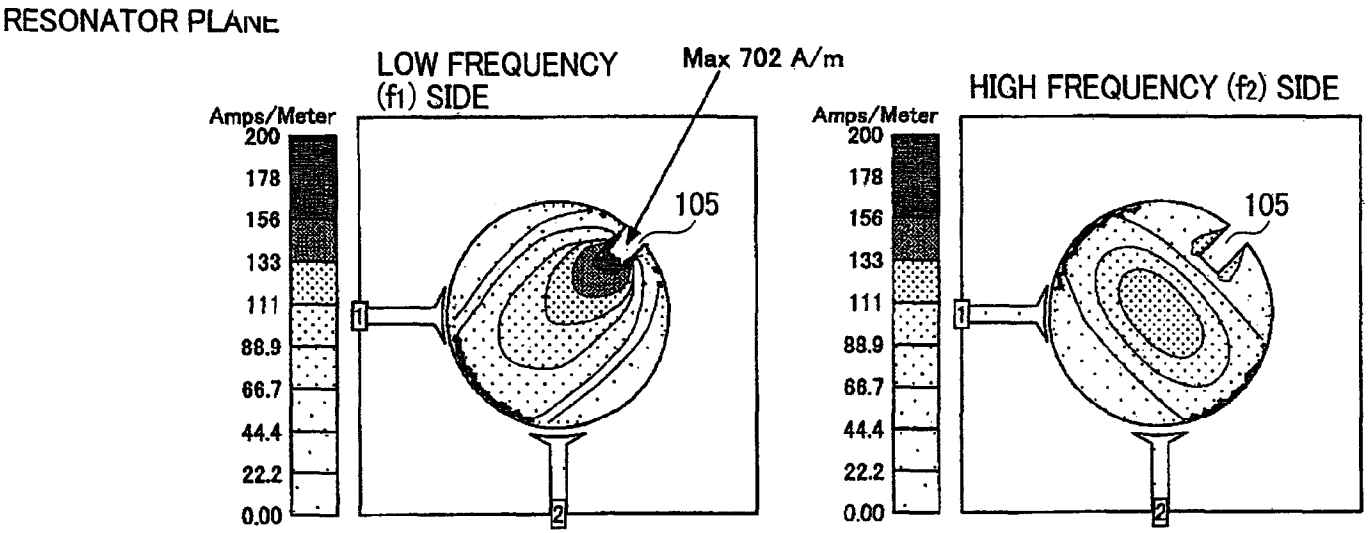
FIG. 2A PRIOR ART
FIGS. 2A and 2B show results of simulation of current density distribution in the conventional notch-type dual-mode resonator filter.
Figure 2B:
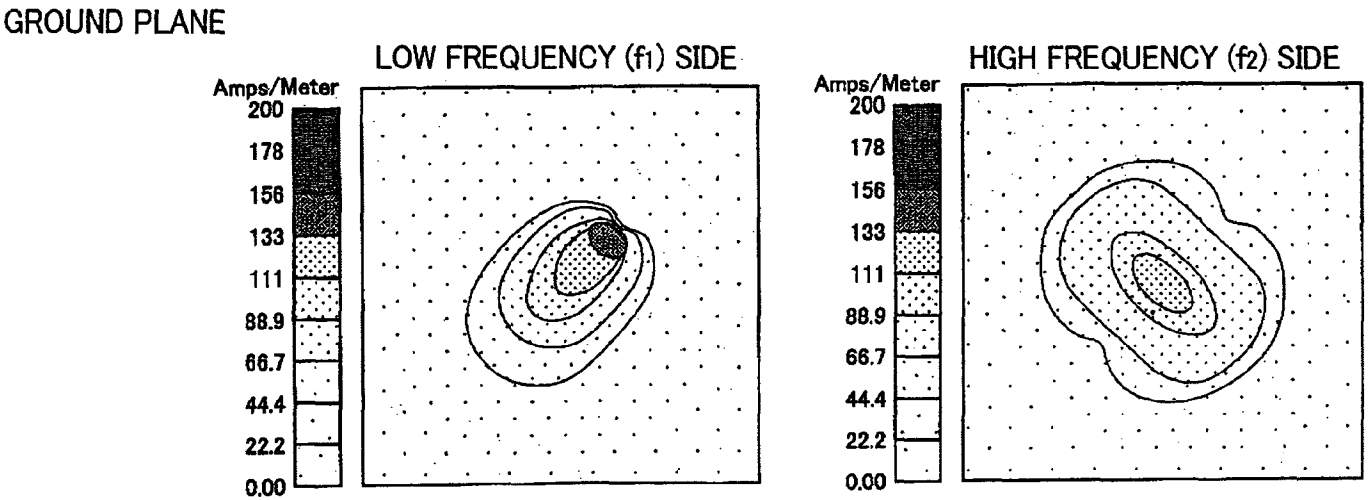
FIG. 2B PRIOR ART
Figure 3A:
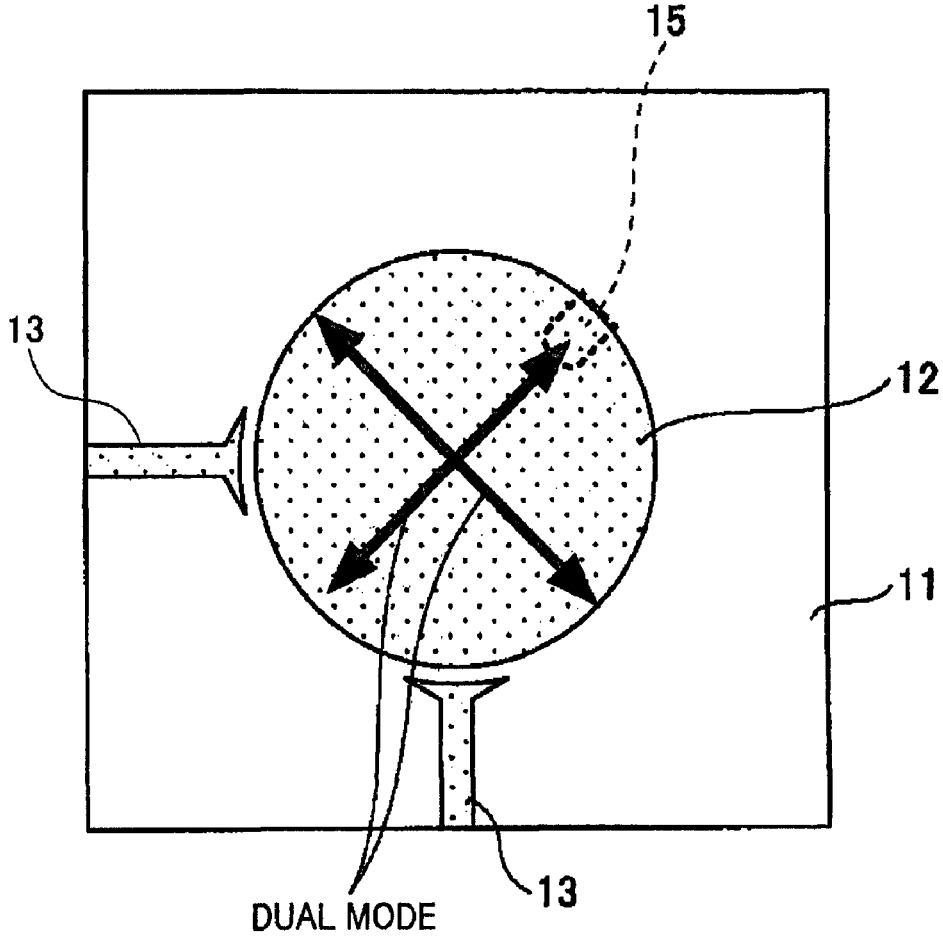
FIGS. 3A and 3B are schematic configuration diagrams of the dual-mode resonator filter according to an embodiment of the invention.
Figure 3B:
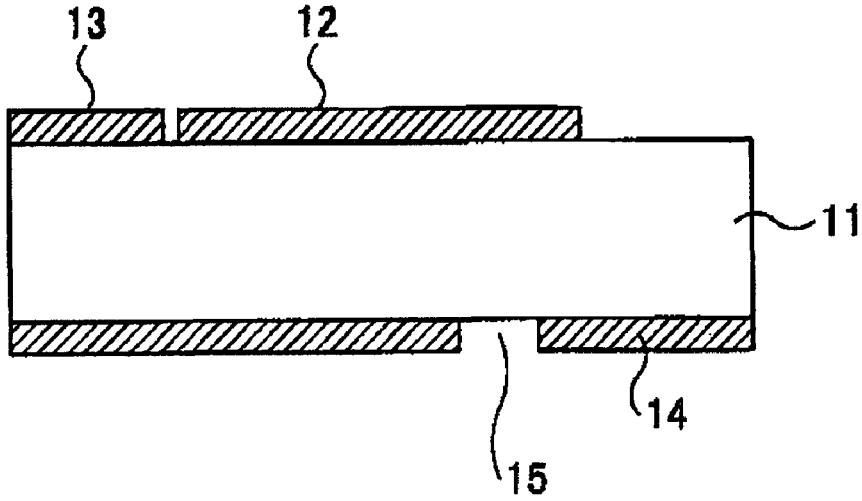

FIGS. 3A and 3B are schematic views of the superconductive device according to an embodiment of the invention. In this example, the superconductive device is used as a superconductive resonator filter. FIG. 3A is a plan view, and FIG. 3B is a schematic cross-sectional view of the resonator shown in FIG. 3A taken along the line that connects input/output signal lines 13 to a notch 15.

The superconductive device includes a disc resonator pattern 12 made of a superconductive material, such as YBCO (Y—Ba—Cu—O), on one side (front side) of a dielectric substrate 11, and a ground film 14 (FIG. 3B) made of the superconductive material on the other side (back side) of the dielectric substrate 11. The ground film (hereinafter also referred to as "ground plane" as appropriate) 14 has, at least in part thereof, an opening pattern 15 including an arc. The opening pattern 15 provided in the ground film 14 induces two resonant modes or dual mode perpendicular to each other in the superconductive device as a resonator filter. Input/output signal lines (feeder) 13 extend on the dielectric substrate 11 to a region close to the disc resonator pattern 12. The input/output signal lines 13 are made of, for example, the superconductive material.

Examples of the dielectric substrate 11 may be a MgO single crystal substrate, a $LaAlO_3$ substrate, or a sapphire substrate. These substrates have relative dielectric constants of 8 to 10 when a signal having a frequency of 3 to 5 GHz is inputted.

Figure 4A:
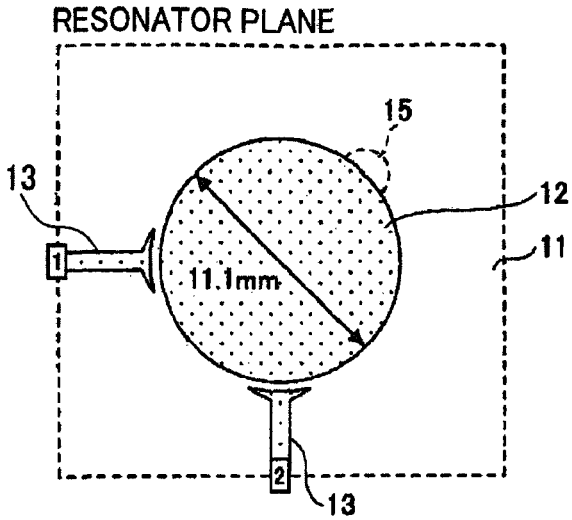
FIGS. 4A to 4C explain the position of an opening pattern formed in a ground plane.
Figure 4B:
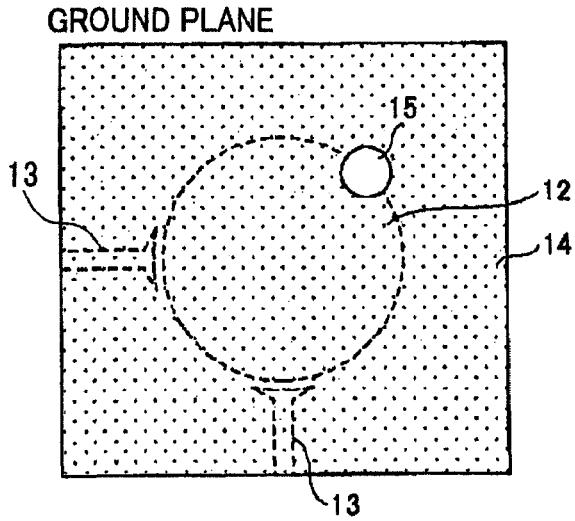
Figure 4C:
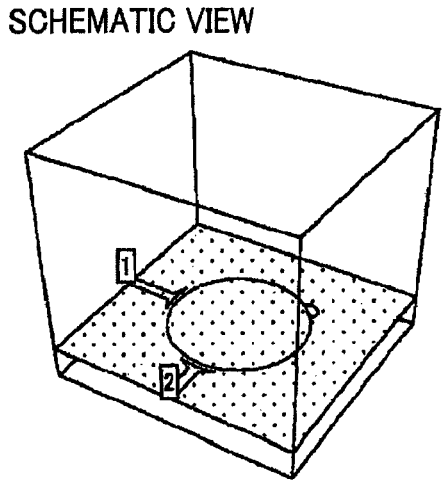

FIGS. 4A to 4C (FIGS. 4A and 4B) show the position of the opening pattern 15 formed in the ground plane 14. FIG. 4A is a top view of the superconductive device (RESONATOR PLANE). The numbers 1, 2, respectively located at the end of line 13 illustrate a signal input/output part from the outside to the line 13. FIG. 4B is a rear view. FIG. 4C is a perspective view. The opening pattern 15 is positioned in a region apart from the extensions of the two input/output signal lines (input line and output line) 13 (FIGS. 4A and 4B). The opening pattern 15 is disposed in such a way that at least part thereof overlaps with the disc resonator pattern 12 (formed on the front side of the dielectric substrate 11) in FIG. 4A. The diameter of the disc resonator pattern 12 is 11.1 mm, for example.

In the example shown in FIGS. 4A to 4C, the opening pattern 15 is provided at a position between the extensions of the two input/output signal lines 13. From the viewpoint of efficient generation of dual modes in the resonator, part or the entire opening pattern 15 desirably overlaps with the disc resonator pattern 12. In relation to the current density, however, the opening pattern 15 is desirably positioned in the periphery of the disc resonator pattern 12 or its vicinity because in the ground plane (ground film) 14, the current likely concentrates in the center or its vicinity. Positions in the periphery of the disc resonator pattern 12 are, for example, the position obtained by projecting the notch in the conventional dual-mode resonator filter onto the ground film 14. That is, to efficiently induce dual modes in the resonator, the opening pattern 15 is desirably disposed at a position where these conditions are satisfied. As long as these conditions are satisfied, the opening pattern 15 can be disposed, for example, at an arbitrary position in the portion of the ground plane that corresponds to the inner area sandwiched between the extensions of the two input/output signal lines 13. It is noted that the extensions are imaginary lines when the two input/output signal lines 13 are extended along the directions toward the pattern.

At least part of the opening pattern 15 has an arcuate section. According to the shape of the arcuate section, the degree of interference (coupling) between the electric and magnetic modes varies. The larger the curvature radius of the arc, the more the current concentration can be reduced. However, since the mode coupling changes and hence the bandwidth increases, the curvature radius of the arcuate section is, for example, desirably smaller than or equal to one-fourth the effective wavelength of the input signal ($\lambda/4$).

Figure 5A:
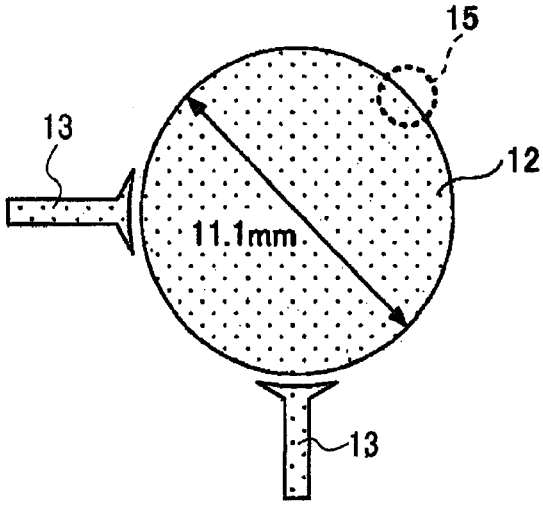
FIGS. 5A to 5C show variations of the opening pattern formed in the ground plane.
Figure 5B:
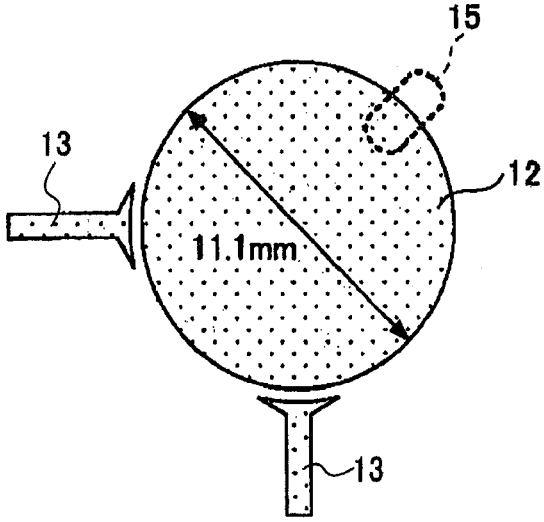
Figure 5C:
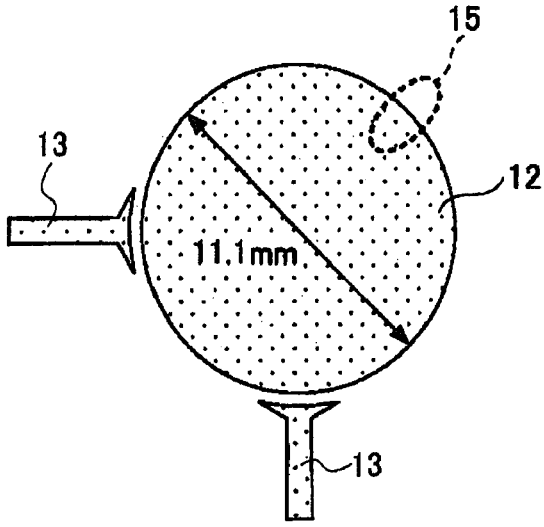

FIGS. 5A to 5C show variations of the opening pattern 15 formed in the ground film 14 (not shown in FIGS. 5A-5C). FIGS. 5A to 5C illustrate variations of the FIGS. 4A-4C. Input/output signal lines (feeder) 13 extend on the dielectric substrate 11 to a region close to the disc resonator pattern 12. The diameter of the disc resonator pattern 12 is 11.1 mm, for example. The opening pattern 15 may be a U-shaped opening shown in FIG. 3A, or may be an arbitrarily shaped opening, such as a circular opening shown in FIG. 5A, a rectangular opening with rounded corners shown in FIG. 5B, an elliptical opening shown in FIG. 5C or the like, as long as the curvature radius of the shape is $\lambda/4$ or smaller.

Figure 6:
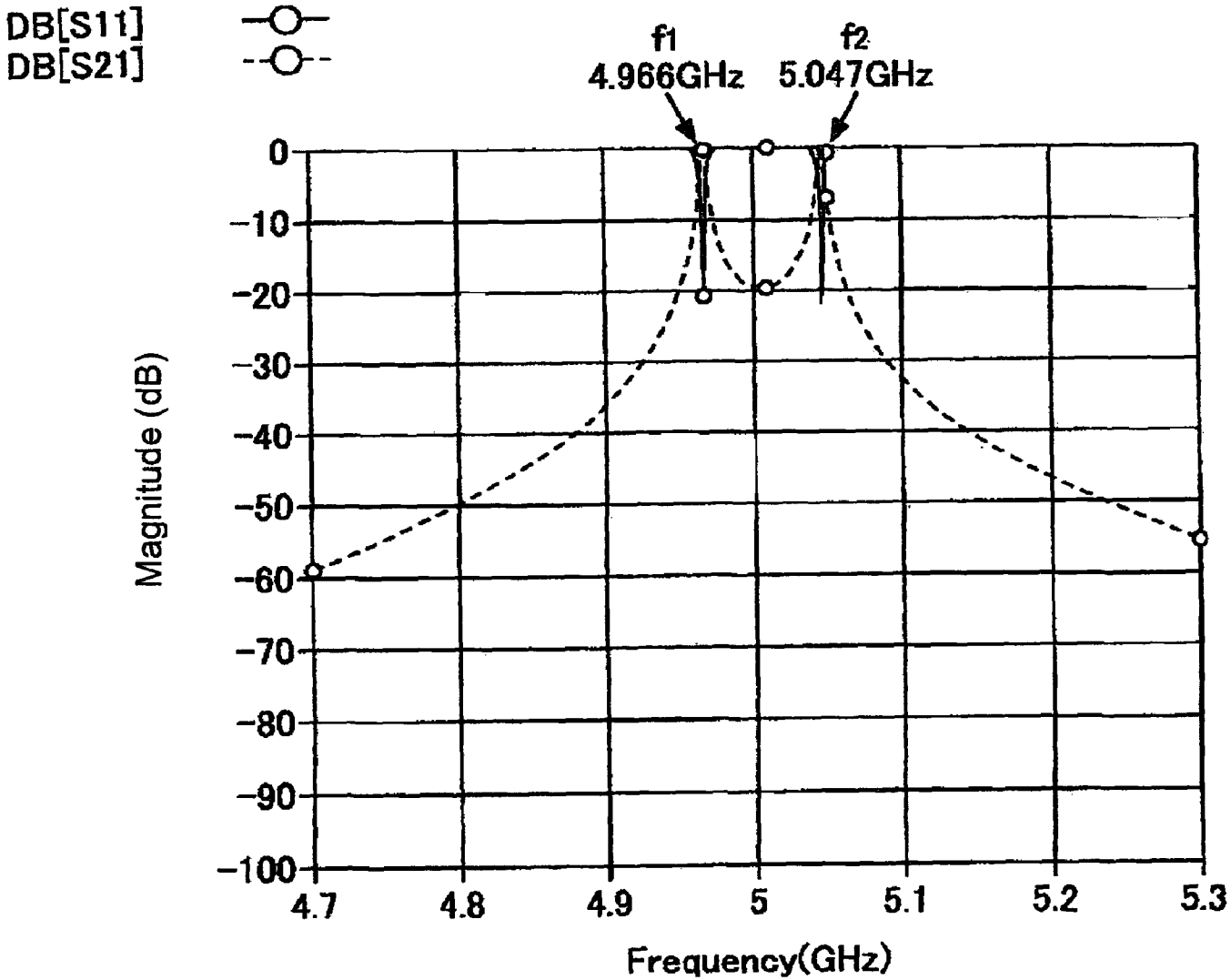
FIG. 6 is a graph showing the frequency response characteristic of the dual-mode resonator filter in the embodiment of the invention.

FIG. 6 is a graph showing the frequency response characteristic of the superconductive device (superconductive resonator filter) according to the embodiment of the invention. In the graph shown in FIG. 6, the horizontal axis represents the frequency (GHz), and the vertical axis represents the magnitude (dB) indicative of the signal transmission characteristic. The sample of the superconductive device for conducting the simulation is a MgO single crystal substrate 11 having a dimension of 20.times.20.times.0.5 mm, both sides of which are covered with a YBCO (Y—Ba—Cu—O-based) thin film using laser deposition. The sample has the shape of the superconductive device shown in FIGS. 4A to 4C. The film thickness of the YBCO thin film can be selected as appropriate according to the filter characteristics. The sample for this simulation has a film thickness of 0.5 μm. First, the YBCO thin film on one side is patterned using a photolithography approach. Then, the disc resonator pattern 12, and the feeders 13 are formed. Next, the opening pattern 15 is formed in the YBCO thin film on the opposite side similarly through photolithography. The diameter of the resonator pattern 12 is 11.1 mm. The opening pattern 15 is a circular opening and its diameter is 2 mm.

As a result of the simulation on the sample, the reflective characteristic (S11) and the transmissive characteristic (S21) shown in FIG. 6 are obtained. Specifically, the sample has two resonant frequencies, 4.966 GHz (f1) and 5.047 GHz (f2), in the 5-GHz band.

Figure 7A:
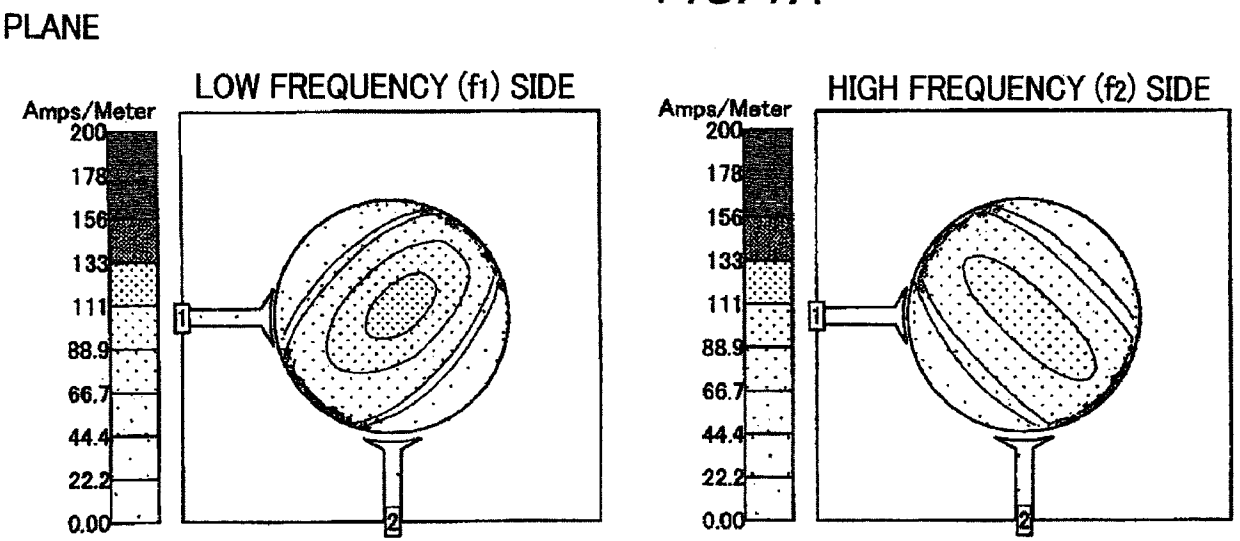
FIGS. 7A and 7B show the results of simulation of the current density distribution in the dual-mode resonator filter according to the embodiment of the invention.
Figure 7B:
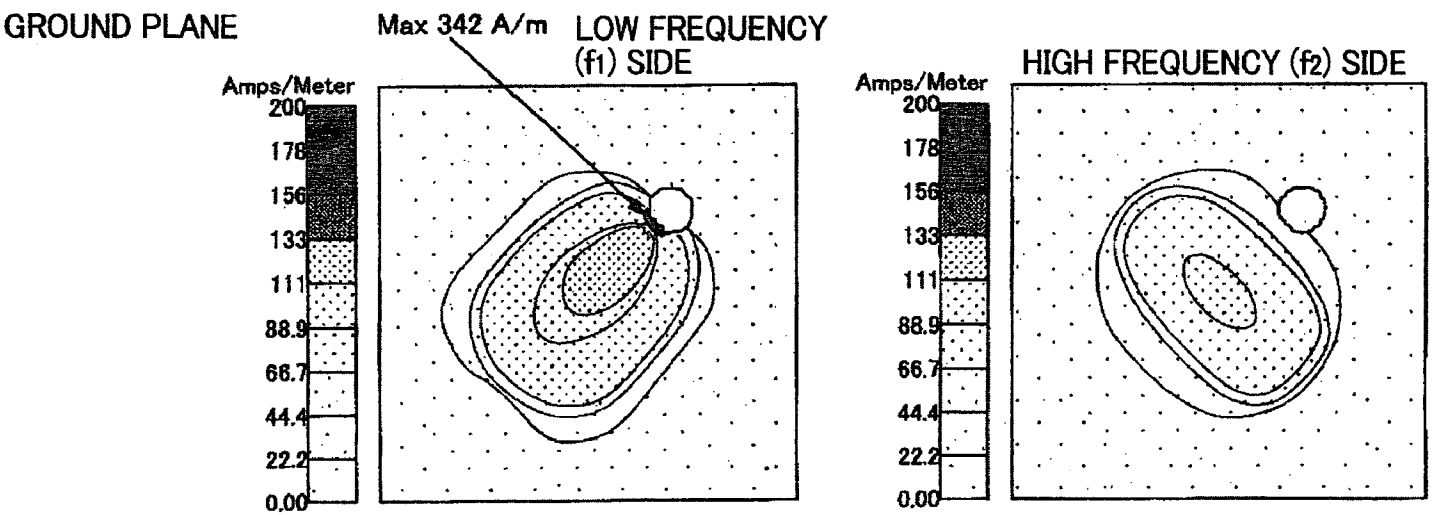

FIGS. 7A and 7B show the results of simulation of the current density distribution in the superconductive resonator filter shown in the embodiment (FIG. 6) described above. FIG. 7A shows the result for the resonator plane, and FIG. 7B shows the result for the ground plane. As shown in FIG. 7A, the current density concentration is effectively reduced in the resonator plane. This results in an excellent effect of reducing loss of high-frequency signals. On the other hand, as shown in FIG. 7B, although the current concentrates around the opening pattern 15 in the ground plane, it is found that the maximum current density is 342 A/m, which is reduced by at least one-half than that in the conventional notch-type dual-mode resonator. In terms of power, this corresponds to the power handling capability at least four times greater.

Since the superconductive device described above has the two resonant modes perpendicular to each other in the 3 to 6 GHz band and excels in the power handling capability, it is expected that the superconductive device can be applied to a next-generation mobile communication system. In this case, for example, the superconductive device is implemented in a metallic package (dewar), and the temperature in the dewar is lowered to approximately 70 to 80° K for use as a superconductive filter. In particular, it is possible to reduce the signal distortion on the high-power transmission side and improve the power characteristic.

This embodiment is not limited to the specific example described above. For example, although the YBCO thin film is used as the superconductive material in this embodiment, an arbitrary oxide superconductive material may be used. Another example of the superconductive material may be RBCO (R—Ba—Cu—O)-based thin film. That is, a superconductive material using Nd, Gd, Sm, or Ho instead of Y (yttrium) as the R element may be used. Alternatively, the superconductive material may be BSCCO (Bi—Sr—Ca—Cu—O)-based or PBSCCO (Pb—Bi—Sr—Ca—Cu—O)-based material. Still alternatively, the superconductive material may be CBCCO (Cu-Bap-Caq-Cur-Ox, $1.5<p<2.5$, $2.5<q<3.5$, $3.5<r<4.5$).

The disc resonator pattern 12 used in this embodiment, that is, the plane-figure resonator pattern 12 made of a superconductive material, is desirably circular (disc-shape) from the viewpoint of eliminating corners and linear portions as much as possible, but an elliptical or polygonal pattern can be used. As described above, by forming the opening pattern 15 including an arc in part of the ground plane 14 formed on the opposite side to the resonator pattern 12, it is possible to reduce current concentration and effectively induce dual modes.

The superconductive device shown in this embodiment is applicable to a bandpass filter on the transmit side used in a mobile communication base station.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A superconductive device comprising:

a dielectric substrate;

a resonator pattern disposed on a first surface of the dielectric substrate, the resonator pattern having a disk shape, the resonator pattern comprising a superconductive material;

an input signal line and an output signal line, each of the signal lines being disposed adjacent to the resonator pattern; and a ground film disposed on a second surface of the dielectric substrate, the ground film comprising the superconductive material, wherein the ground film includes an opening pattern, the opening pattern being provided in a region corresponding to a region between a first imaginary line extending from the input signal line over the resonator pattern and a second imaginary line extending from the output signal line over the resonator pattern.

2. The superconductive device according to claim 1, wherein the opening pattern includes a circular arc.

3. The superconductive device according to claim 2, wherein the curvature radius of the circular arc is smaller than or equal to one-fourth a wavelength λ of an input signal.

4. The superconductive device according to claim 1, wherein the dielectric substrate has a relative dielectric constant of 8 to 10 when a signal having a frequency of 3 to 5 GHz is applied.

5. The superconductive device according to claim 1, wherein the superconductive device has two resonant modes perpendicular to each other in the 3 to 6 GHz band.

6. The superconductive device according to claim 1, wherein part of the opening pattern overlaps with a region where the resonator pattern is located.

7. The superconductive device according to claim 1, wherein the opening pattern is provided at a position corresponding to a periphery of the resonator pattern.

8. The superconductive device according to claim 1: wherein the opening pattern is provided at a position corresponding to a position close to a center of a region between the first imaginary line and the second imaginary line.

9. The superconductive device according to claim 1, wherein the superconductive material comprises an oxide superconductive material.

10. The superconductive device according to claim 1, wherein the opening pattern is a circular opening pattern.

11. The superconductive device according to claim 1, wherein the opening pattern is a U-shaped opening pattern.

12. The superconductive device according to claim 1, wherein the opening pattern is a rectangular opening pattern, with corners which are curved and rounded.

13. A superconductive device comprising:

a dielectric substrate;

a resonator pattern disposed on a first surface of the dielectric substrate a resonator pattern comprising a superconductive material; and a ground film disposed on a second surface of the dielectric substrate, the ground film comprising the superconductive material, wherein the ground film includes an opening pattern, the opening pattern being a U-shaped opening pattern.

14. A superconductive device comprising:

a dielectric substrate;

a resonator pattern disposed on a first surface of the dielectric substrate a resonator pattern comprising a superconductive material; and a ground film disposed on a second surface of the dielectric substrate, the ground film comprising the superconductive material, wherein the ground film includes an opening pattern that includes a circular arc, the curvature radius of the circular arc being smaller than or equal to one-fourth of a wavelength λ of an input signal.

* * * * *